US005642573A

United States Patent [19]

Brown

[11] Patent Number: 5,642,573

[45] Date of Patent: Jul. 1, 1997

[54] SHOE WITH INTEGRAL STORABLE GAITER

[76] Inventor: Jeffrey P. Brown, 4878 Monroe Ave., San Diego, Calif. 92115

[21] Appl. No.: 538,292

[22] Filed: Oct. 2, 1995

[51] Int. Cl.[6] ..... A41D 17/00; A43B 5/00

[52] U.S. Cl. ..... 36/2 R; 36/132

[58] Field of Search ..... 36/2 R, 132, 136, 36/9 R, 114

[56] References Cited

U.S. PATENT DOCUMENTS

| | | | |
|---|---|---|---|
| 984,608 | 2/1911 | Roberts | 36/2 R X |
| 1,635,298 | 7/1927 | Willette | 36/2 R |
| 3,477,147 | 11/1969 | Bauer | 36/2 R |
| 4,461,030 | 7/1984 | Knudsen | 36/2 R X |
| 4,777,743 | 10/1988 | Roehrig, Jr. | 36/132 |
| 4,817,306 | 4/1989 | Bayer | 36/132 X |
| 4,856,207 | 8/1989 | Datson | 36/2 R |
| 4,896,437 | 1/1990 | Johnson | 36/2 R X |

FOREIGN PATENT DOCUMENTS

| | | | |
|---|---|---|---|
| 2601859 | 1/1988 | France | 36/2 R |
| 246685 | 2/1926 | United Kingdom | 36/2 R |

*Primary Examiner*—B. Dayoan

[57] ABSTRACT

A shoe 48 with an integrally fastened gaiter 40, the lower end 60 of gaiter 40 being permanently attached to the inside of a gaiter storage pouch 46 which is located at the ankle collar 64 of the shoe 48. The gaiter 40 has an opening at its front, defined by its two flaps 30, 38 which, when in use, closed and fastened, seal out moisture, dirt, rocks, sand, stickers, and various other types of debris possibly encountered while using the shoe 48. The upper portion of the gaiter 40 has a constrictive top 34, (such as elastic), to constrict gaiter 40 around a wearer's leg, sealing out moisture, dirt, rocks, sand, stickers, and various other types of debris possibly encountered while using the shoe 48. The lower portion front opening of the gaiter 40 secures to the shoe tongue 28, sealing out moisture, dirt, rocks, sand, stickers, and various other types of debris possibly encountered while using the shoe 48. When not in use the gaiter 40 is rolled, folded, or scrunched down, then stuffed into the gaiter storage pouch 46. The pouch 46 is then closed, (in this embodiment, by closing a zipper system 42, 54, 56 located at the top of the pouch). This keeps the gaiter 40 completely out of the way of normal shoe operation and use, protects the gaiter 40 from damage, and provides for an aesthetically pleasing look of the shoe 48 which matches the look of a typical shoe and, thus, is undetectable as a gaiter or obvious appurtenance, allowing the shoe to be worn as normal day-to-day footwear.

18 Claims, 5 Drawing Sheets

SHOE WITH INTEGRAL STORABLE GAITER

BACKGROUND

1. Field of Invention

This invention relates to a shoe (which term is used herein generically and includes all shoe types), and more specifically to an integral storable gaiter which is permanently attached within a protective storage pouch that is located at the ankle collar of the shoe.

2. Description of Prior Art

Mountaineers, hikers, hunters, and outdoor people of many types, from bird watchers to mountainbikers, commonly have problems with moisture and debris getting in their shoes. Originally, inventors created gaiters as separate devices to be attached to shoes, as needed, in order to keep out moisture. (Gaiters come in many shapes and sizes. Since the Patent And Trademark Office first opened in 1790, there have been 529 separate inventions created under "Gaiter, Class 36"). Although useful, gaiters were not originally developed to address the need to keep debris, but rather moisture and water, from entering shoes, and suffer from several other disadvantages as well:

A typical gaiter, as defined by Webster's Collegiate Dictionary, is used in conjunction with a shoe, is a commonly manufactured article of wear designed to keep moisture from entering the shoe and is made of a flexible material leg covering reaching from the instep to ankle, mid-calf, or knee. When employed for use the gaiter is usually fastened to the shoe with strapping which runs under the instep of the shoe and is held in place by the shoe's heel which acts as a catch. Although this system keeps snow and mild amounts of moisture out of the shoe, it nevertheless has the major disadvantage of having to utilize two separate articles of wear. Since the gaiter is a separate component it often works its way loose and allows infiltration of elements into the shoe.

Also, even when worn in the snow, the strapping under the shoe's instep can become abraded when the shoe's sole comes in contact with sharp edges, such as exposed patches of dirt and rocks. This wear causes the strapping to break if not replaced, thus, causing the gaiter to become loose and completely ineffective in keeping snow and moisture from entering the shoe.

Since the strapping is highly sensitive to wear, the separate gaiter is not able to be utilized in terrain other than soft snow or sand. If worn to keep out stickers or debris such as dirt and rocks encountered while hiking, especially dry weather hiking, the strapping constantly comes in contact with sharp edges such as rocks and sticks, becomes abraded and breaks, causing the separate gaiter to become useless.

Although typical gaiters can be useful and lightweight, they are inconvenient to employ and they can easily be lost since they are separate of the shoe.

Also, since typical gaiters are separate items, users must always have enough forethought to anticipate the need for gaiters in order to bring them along before embarking on a journey. Since always knowing in advance that one will experience a situation that requires gaiters is impossible, outdoor people are more often than not encountering such situations without protection of gaiters, simply because the gaiters were left behind.

Lastly, because gaiters and shoes are separate components, the gaiters must be carried separately in one's hands or some type of separate carry sack when not being used.

Although shoes and gaiters are normally separate components, one invention known to this applicant which is a single article is U.S. Pat. No. 4,856,207 to Datson (1989). Datson has accomplished this by utilizing a closed, tubular gaiter having a lower end and an upper end with a waterproof joint between the gaiter lower end and the outer surface of the footwear, circumscribing the footwear above its sole.

Although the Datson patent accomplishes joining a gaiter to a shoe, it nevertheless suffers from a number of disadvantages:

The Datson patent is very narrowly scoped in that it was designed specifically to prevent entry of water into a shoe when its gaiter is extended and the shoe is worn across wet and swampy ground, or through creeks and rivers, or in heavy rain. In so being designed, it has the major drawback of actually being a waterproof shoe with an extendable upper (gaiter);

Additionally, the Datson patent is difficult to use due to the closed, tubular design of the extended upper (gaiter). The upper (gaiter) must be rolled down to access upper lacing flaps located on the shoe; these flaps must be laced to completely close the shoe. Thus, presumably, when not in use the extended upper (gaiter) is left in the rolled down position, but requires the shoe wearer to unsnap the front gusset of the rolled down upper (gaiter) in order to access the upper lacing flaps.

Another major drawback to the Datson Patent is that the upper (gaiter) is left exposed when not in use, i.e., in the rolled down, non-use position, thus, leaving it susceptible to damage.

Also, the Datson patent simply does not possess a neat and uniform appearance of typical footwear when the extended upper (gaiter) is in the rolled down, non-use position.

Finally, the result of the Datson patent is a cumbersome article of footwear with no practical functional purpose other than its single specific intended design use.

OBJECTS AND ADVANTAGES

Accordingly, in view of the prior art, "gaiter", several objects and advantages of the instant invention are:

- To provide a leg covering gaiter which addresses the need to keep debris, in addition to moisture, from entering shoes of all types, and which does not require strapping which must be employed under the shoe's instep.
- To provide a leg covering gaiter which is not a separate component, but rather an integral element of a shoe, unable to come loose from the shoe, thus, never allowing debris and moisture into the shoe due to breakage of fasteners such as straps.
- To provide a leg covering gaiter which can maintain form and function in all types of terrain, especially dry weather hiking, and in areas which have sharp rocks and sticks.
- To provide a leg covering gaiter which is convenient to employ and can not be lost unless the entire shoe is lost.
- To provide a leg covering gaiter which is always available for use with the shoe and can never be forgotten behind.
- To provide a leg covering gaiter which does not have to be carried in one's hands or in some type of separate carry sack.

Also, in view of the prior art, "U.S. Pat. No. 4,856,207 to Datson (1989)", several objects and advantages of the instant invention are:

To provide a shoe with integral gaiter which addresses the need to keep all types of debris, in addition to moisture, from entering shoes.

To provide a shoe with integral gaiter which is easily and effectively employed for use and which does not require extra steps or manipulation of the gaiter in order to lace the shoe.

To provide a shoe with integral gaiter which does not leave the gaiter exposed to damage when the gaiter is not in use.

To provide a shoe with integral gaiter which possesses a neat and uniform appearance of typical footwear.

To provide a shoe with integral gaiter that is a non-cumbersome article of footwear and which also has a practical, functional "day-to-day" shoe purpose, rather than just a single design use.

Further objects and advantages of the instant invention are to incorporate two previously separate elements, shoe and gaiter, into a single, functional, and specifically non-cumbersome article of footwear which can be used either with the gaiter employed, or under normal circumstances, (i.e., as a regular day-to-day shoe), which is simple to use and does not require special manipulation of its integral gaiter to be worn under said normal circumstances. Additionally, to provide a shoe which utilizes an easily employed, non-restrictive integral gaiter to keep debris as well as moisture from entering the shoe rather than a shoe with an extended upper, or a shoe with a tight or restrictive ankle collar to attempt to achieve this purpose.

Additional advantages and uses are numerous, due to the connected, readily, and easily accessible gaiter. These uses are not limited to, but could include work-boots (i.e., boots that a laborer/ditch digger would use to keep debris from entering the shoe), or shoes worn by a bicycler (this use would allow a bicycle rider to stuff his/her pant leg inside the gaiter so as not to get the pant leg caught in the bicycle's sprocket), or jogging shoes (this use would allow a jogger to comfortably use the shoe in numerous areas, such as on the beach without getting sand in his/her shoes); just to name a few.

Still further objects and advantages will become apparent from a consideration of the ensuing description and drawings.

BRIEF DESCRIPTION OF THE DRAWINGS

The preferred embodiment of my invention is described hereunder in some detail with reference to, and as illustrated in, the accompanying drawings in which.

DETAILED DESCRIPTION OF THE DRAWINGS

Figure 1:
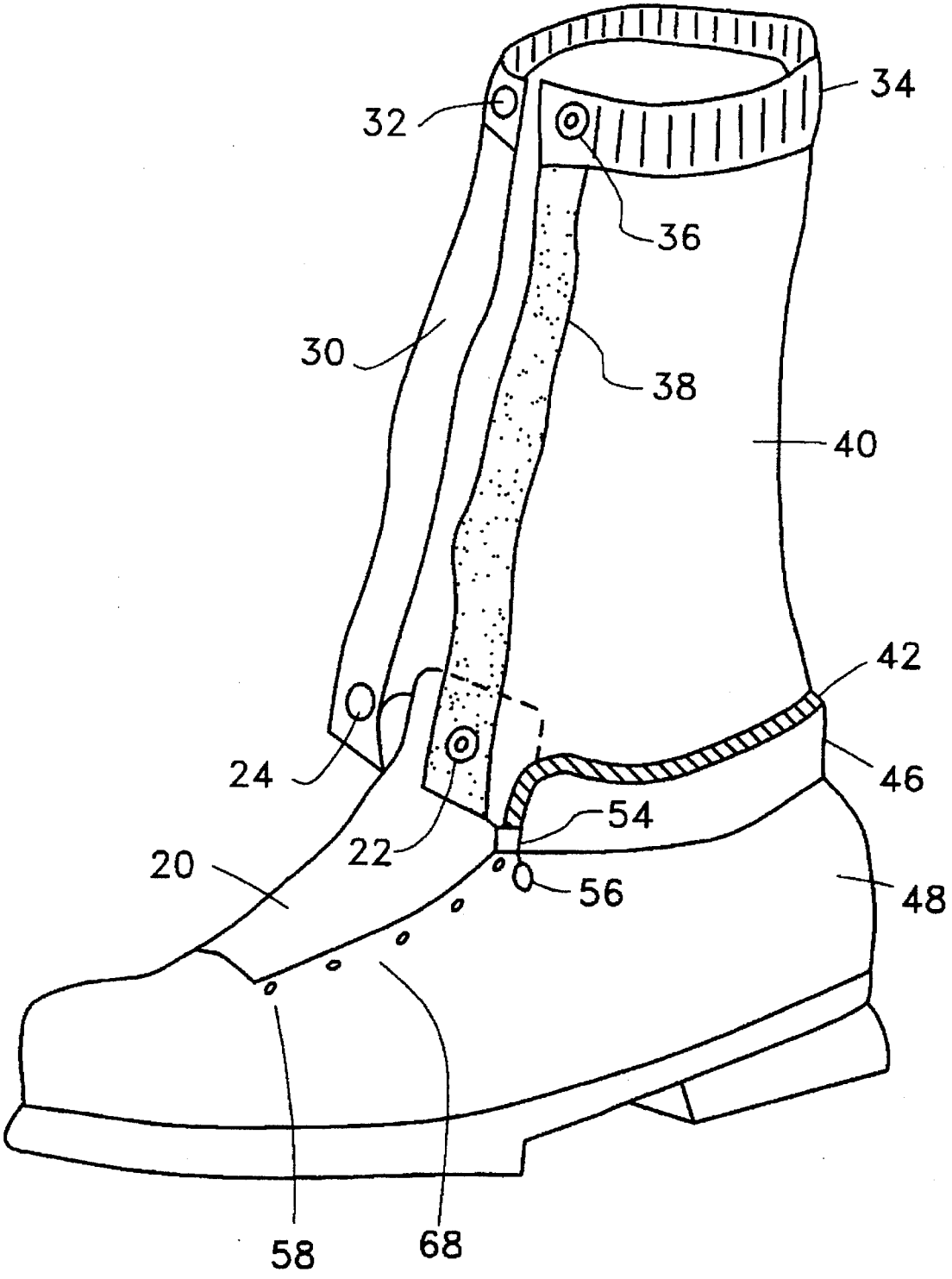
FIG. 1 is a front perspective view of the shoe and storable gaiter, with the gaiter extended and ready to cover the leg of a user; (note: this illustration depicts a low-top shoe, but my invention will work on mid-tops or high-tops as well)
Figure 2:
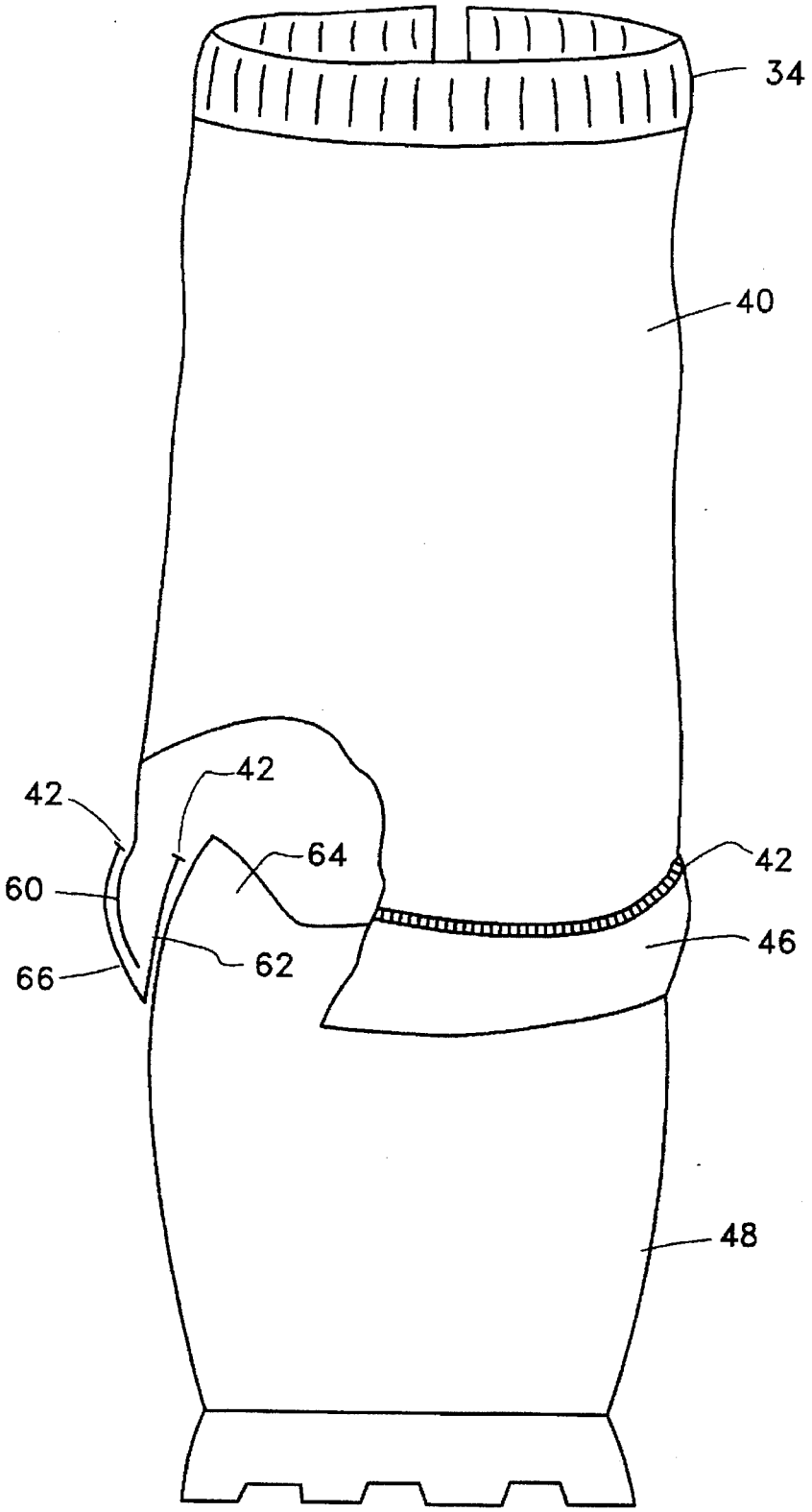
FIG. 2 is a rear view of the shoe and storable gaiter with the gaiter in the extended position and illustrating the attachment of the gaiter inside its storage pouch at the shoe's ankle collar via a "broken" view of the gaiter and storage pouch.

A preferred embodiment of this invention is illustrated in FIG. 1. A shoe 48 and gaiter 40 are integrally joined within a protective gaiter storage pouch 46. FIG. 2 best illustrates the attachment of the gaiter 40 at its bottom 60 to the outer side 66 of the protective storage pouch 46. The storage pouch 46 is integral to the shoe 48, being secured at its inner side 62 to the ankle collar 64 of the shoe 48.

Figure 3:
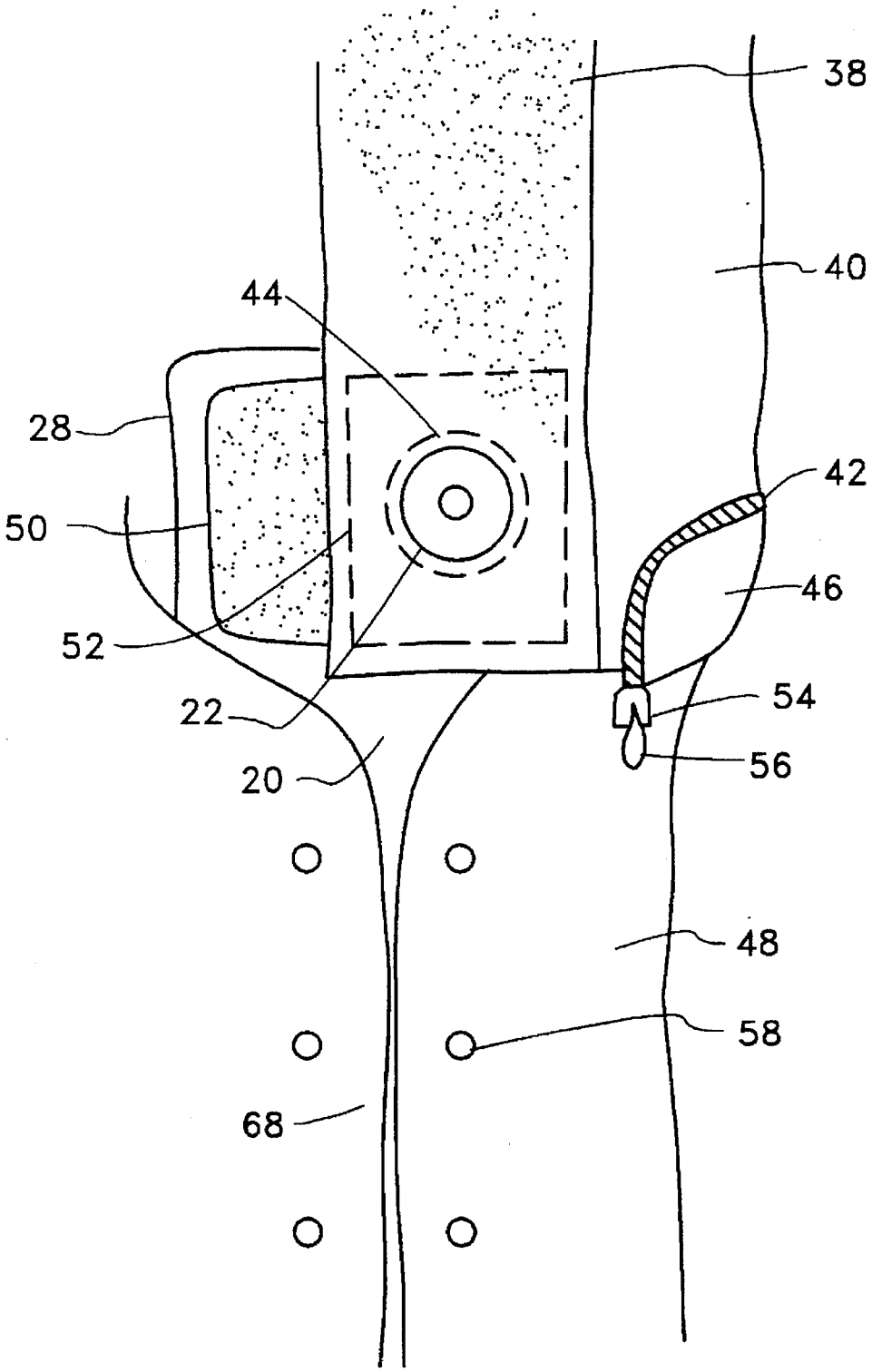
FIG. 3 is a close-up front view, drawn to a larger scale, showing the shoe and gaiter at the shoe tongue area.

The shoe 48 is not unlike typical shoes, possessing shoe lacing flaps 68 with typical shoe lace eyelets 58 and a shoe tongue 20 connected at its sides to the shoe lacing flaps 68, except that, as illustrated in FIG. 3, the shoe tongue 20 has, located at its top 28, a joining fastener system 44 (i.e., a snap), and closure mate 52 to fasten with closure mate 50 and hold inner gaiter flap 38 in place at shoe tongue top 28.

FIG. 1 shows the bottom portion of gaiter flaps 30, 38 equipped with fasteners 22, 24 (i.e., a snap), designed to secure outer gaiter flap 30 to inner gaiter flap 38; to hold gaiter 40 in place at shoe tongue top 28. The upper end of the gaiter 40 is provided with a constrictive top 34 and fasteners 32, 36 (i.e., a snap), to keep the gaiter 40 closed and in place around a wearers leg.

Figure 4:
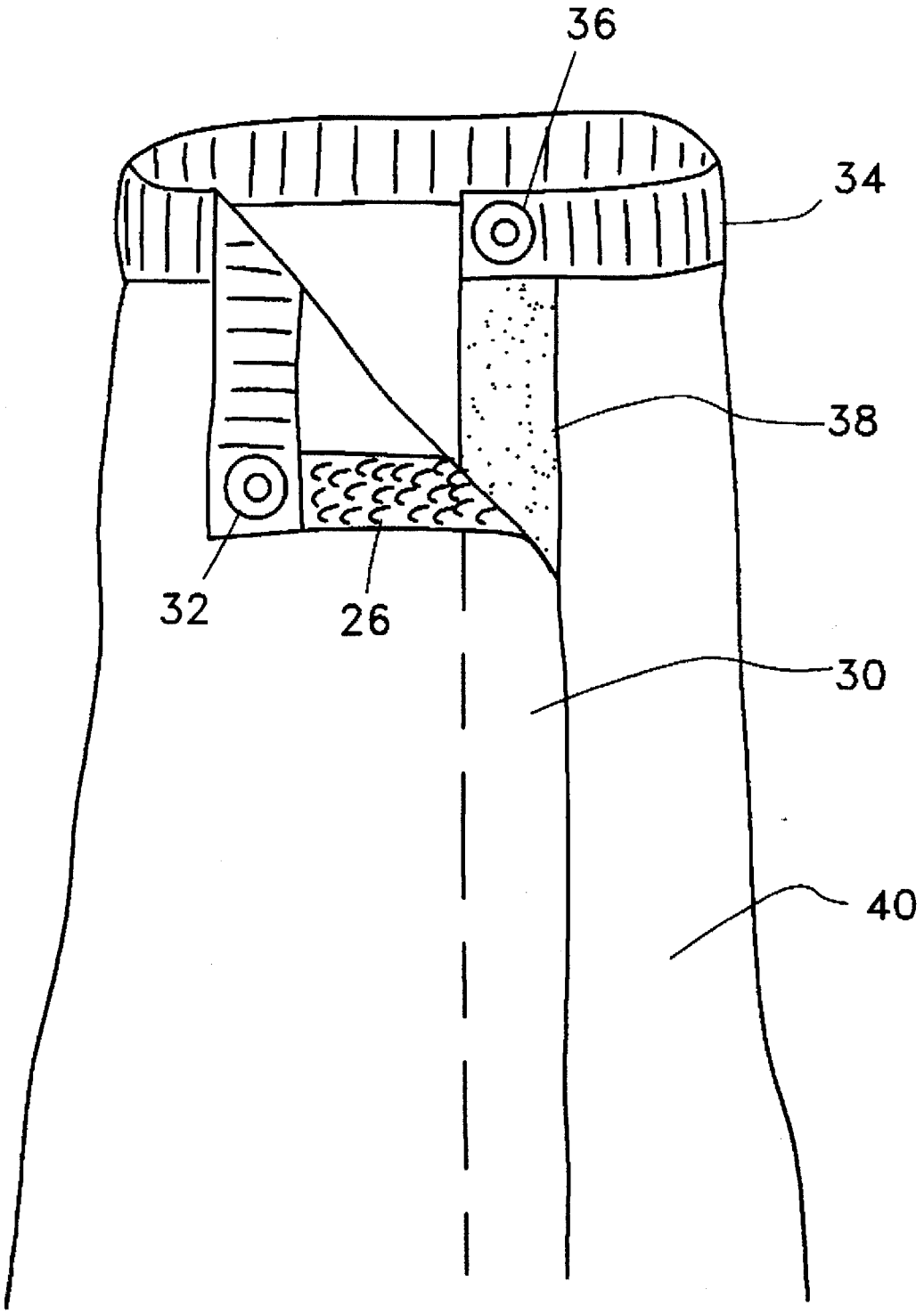
FIG. 4 is a front view, drawn to a larger scale, showing the gaiter top with the gaiter partially open.

FIGS. 1 and 4 illustrate the front of the gaiter 40 being equipped with a "touch and hold" or "hook and loop" fastener system, (such as that sold under the Registered trade Mark "VELCRO"), located on the underside of outer gaiter fastening flap 30, and represented as 26, to mate with inner gaiter fastening flap 38; (note that closure mate 50 and 52 are also of "VELCRO"). This closure system allows the wearer to quickly and easily employ the gaiter 40 for use, as well as quickly and easily restow it in the gaiter storage pouch 46 when no longer needed.

Figure 5:
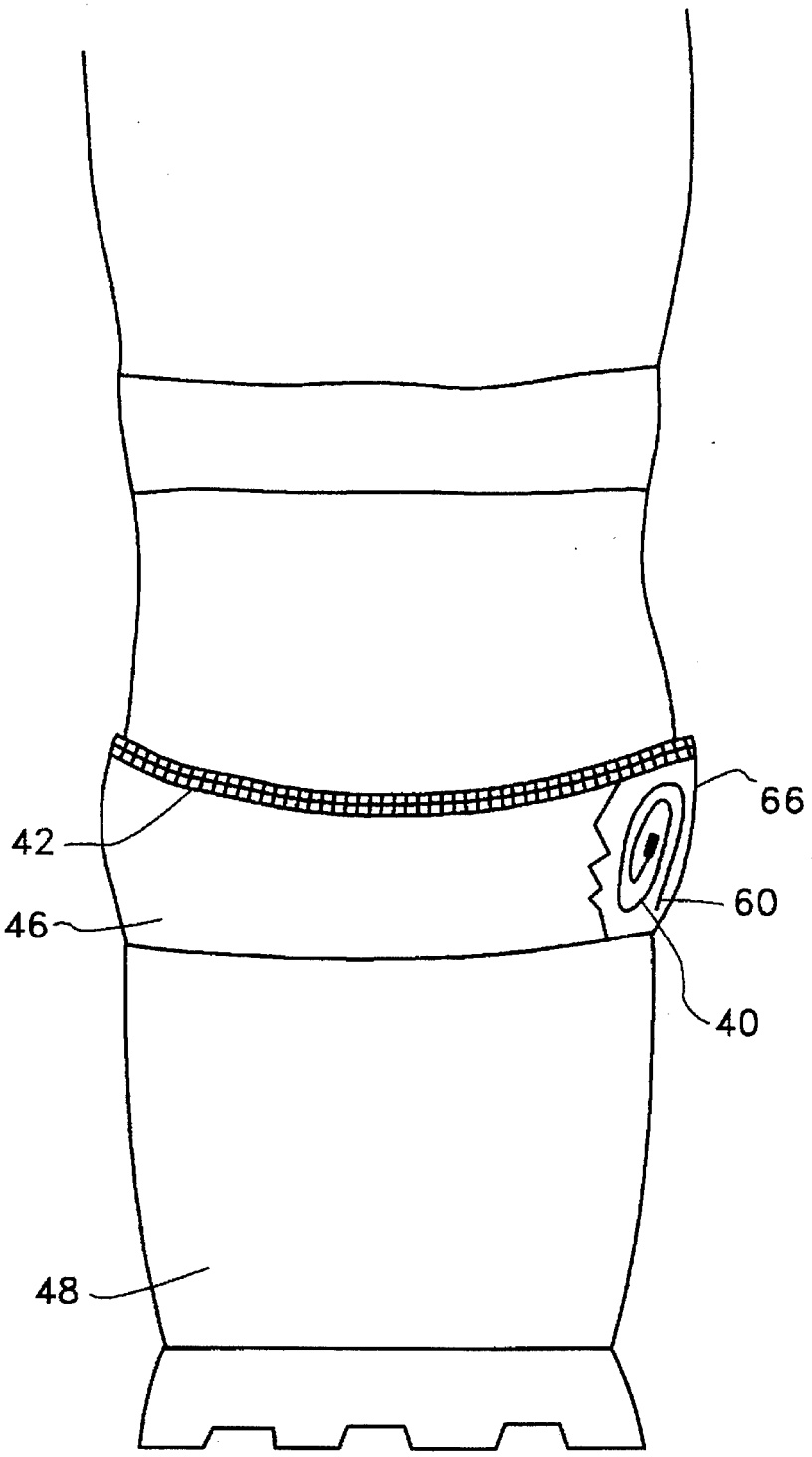
FIG. 5 is a rear view of the shoe and storable gaiter, (the shoe being shown on a user's foot), with the gaiter shown stowed in its storage pouch via a "broken" view of the storage pouch.

FIG. 3 shows the storage pouch 46 with a zipper 42, and grasp loop 56 for the zipper control 54. FIG. 5 illustrates how the stored gaiter 40 is protected when stowed within the closed storage pouch 46. This storage of the gaiter 40 provides a neat appearance of the shoe 48, also depicted in FIG. 5.

The gaiter material used in this embodiment comprises a foldable membrane such as coated rip-stop nylon, or a laminate of micro-porous polytetrafluoroethylene (PTFE) sheet sandwiched between two sheets of woven material. Such a product is available from W. L. Gore & Associates (U.K.) Ltd. of Scotland under the Registered Trade Mark GORE-TEX. The microporous PTFE sheet or membrane discriminates between water in droplet form and water in vapor form, allowing water vapor to pass through but inhibiting the flow of liquid water.

As the reader can see, this invention, as illustrated in this particular embodiment, is applicable to all types of shoes, (not just those which might be used in snow, mud, swamps, bogs, or other wet terrain), provided their tongue crosses the flexion zone of the shoe and extends up to the ankle collar of the shoe, regardless of the height of the shoes ankle collar; (i.e., low-top, mid-top, high-top, etc.).

In the illustrated embodiment of this invention a "touch and hold" fastener system (VELCRO) is shown at the gaiter front closure and an elastic type constrictive system is shown at the gaiter top. However, these systems could be designed differently, such as a stud or snap system, and pull cord draw system, respectively.

From the description above, a number of advantages of the shoe with integral storable gaiter become evident:

(a) The presence of an integral gaiter, designed specifically to keep debris in addition to moisture from entering the shoe, addresses the need to be able to have a system available for said design at a moments notice.

(b) Since this invention utilizes an integral gaiter, the shoe and gaiter can not separate, and, thus, will not allow moisture and debris into the shoe. Additionally, since the gaiter, which is of a flexible material, is housed in a neat, protective, and flexible storage pouch, the system is not cumbersome if one uses the shoe solely as a typical shoe without the need for a gaiter; (i.e., typical day-to-day footwear).

(c) The fact that this invention utilizes a gaiter which is deployed from a storage pouch located at the ankle collar obviates the need for strapping under the sole of the shoe. This system also does away with the need for the user to manipulate the gaiter in some way in order to use or lace the shoe every time the shoe is used, as in the case with the Datson patent.

(d) In not utilizing strapping, this invention allows the gaiter to be used under all circumstances and in all terrains, such as areas which have sharp rocks or sticks.

(e) By stowing the gaiter in the protective storage pouch when not in use, the gaiter is completely protected from unnecessary or accidental damage. In addition to being permanently secured, this storage pouch system does not allow the gaiter to be lost, forgotten, stolen, or left behind. The system also does away with the need for separate gaiters to be carried in one's hands or in some sort of separate carry sack.

(f) The presence and use of an integral aesthetic gaiter storage pouch provides for a shoe which can be used solely as a shoe, with the gaiter system completely undetectable, yet ready for use at a moments notice. This design allows the user of the shoe to wear the shoe under normal conditions, as a "normal" day-to-day shoe, and makes unnecessary the need for the user to purchase and have available a second pair of shoes which will accept the attachment of separate gaiters, (i.e., shoes with heels are necessary in order to provide a catch for the instep strapping used on typical gaiters), or shoes which utilize the cumbersome Datson patent concept.

Operation—FIGS. 1 to 5

The present invention comprises an integral gaiter located at the ankle collar of a shoe such that when not in use the gaiter is stuffed within a protective storage pouch to keep it out of harms way and out of the way of the shoe wearer when the shoe is being worn under normal non-gaiter necessary circumstances. The gaiter is extended from its storage pouch when needed and fastened around the leg of the shoe wearer, forming a complete closure, to keep out not only moisture, but dirt, rocks, sand, stickers, and various other types of debris possibly encountered while using the shoe.

The gaiter is integrally fastened at the ankle collar of the shoe and is housed within a closeable storage pouch. The gaiter is secured to the interior surface of the outer side of the pouch so as to form a uniform exterior surface between the shoe and the gaiter when the gaiter is extended; this uniform design keeps the pouch from filling with debris when in the open position with the gaiter extended for use.

To use the gaiter, one must first open the gaiter storage pouch, (in this embodiment, by unzipping it). Next, one unrolls or unfolds the stuffed/stowed gaiter from its pouch, (note that the gaiter is attached and integral to the shoe and will not come loose from the shoe), and wraps the gaiter around his/her leg. The lower portion of the gaiter is then secured at the shoe tongue via the shoe tongue and gaiter fastening system, located at the shoe tongue and on the inner and outer flaps of the gaiter, shown in FIG. 3. The gaiter fastening flaps are then secured to each other along their edge, depicted in FIG. 4. Finally, one secures the upper constrictive top of the gaiter, sealing the gaiter at the users leg. Now, fully employed, the gaiter is ready for use and will prevent moisture, dirt, rocks, sand, stickers, and various other types of debris possibly encountered while using the shoe from entering the shoe.

The invention does not require strapping of any kind and because the gaiter is integrally affixed at the ankle collar of the shoe the gaiter remains in place and provides complete closure at the shoe's ankle collar. This design allows for the use of the gaiter in the roughest of terrains, such as steep hillsides with rocks, sticks, and scree, as well as in mild areas such as desert sands, or snow, without displacement of the gaiter on the wearer's leg, or damage to a third component such as strapping.

From the description above, one can see that the invention incorporates two separate elements into a single, functional, and specifically non-cumbersome article of footwear, functioning exactly like a regular shoe without the need to manipulate upper shoe lacing flaps and gaiter gusset snaps as in the Datson patent. The present invention also utilizes the benefits of an integrally built-in gaiter, while requiring no special consideration to such things as strapping, typical of regular gaiters, or the upper shoe lacing flaps and gaiter gusset snaps of the Datson patent.

Accordingly, the reader will see that a number of advantages of the invention are apparent. Although this invention is not intended to be completely waterproof in submersed situations, such as the Datson patent, it is designed to impede the flow of moisture into the inside of the shoe, such as when being worn in the snow, or in moderately damp situations such as rain.

Specifically, this invention is designed to completely block entry into the shoe of dirt, rocks, sand, stickers, and various other types of debris possibly encountered while using the shoe; for the gaiter to be quickly and easily employed when needed; for the gaiter to be stored in a protective pouch in order to keep it from being damaged when not in use; to keep the gaiter out of the way of the normal operation of the shoe; and, lastly, to be aesthetically equal to a "normal/typical" shoe, thus, allowing the shoe to be worn as regular "day-to-day" footwear.

One of the most significant and practical benefits of my design is that the gaiter is always available for use. The shoe wearer does not have to make sure that gaiter use has been planned on in advance and be certain to have gaiters available. The gaiter in my invention can be employed on the spur of the moment, as well as quickly and easily restowed when no longer needed.

This ease of use allows the shoe wearer to easily and readily adjust for varying weather and terrain conditions, and in so doing, keep moisture, dirt, rocks, sand, stickers, and various other types of debris possibly encountered while using the shoe from entering the shoe. But of equal importance is the fact that the shoe user does not have to manipulate the gaiter every time he/she uses the shoe, such as in the Datson patent. This quite clearly allows the user to utilize the shoe as a "normal/typical" shoe.

Finally, and of significant importance, is the fact that by having an easily employable gaiter integral to the shoe, the shoe user will be able to keep the shoe interior completely free from both moisture and debris. Since moisture and dirt are extremely damaging to the components on the interior of shoes, this equates to the shoe materials, such as adhesives, stitching, and natural and manmade fabrics not breaking down and deteriorating as quickly as usual, thus, significantly prolonging the useable life of the shoe. Keeping these damaging elements out of the shoe also keeps the foot of the shoe wearer clean and dry which will reduce the occurrence of fungus, hot-spots, sores, and blisters.

Although the description above contains many specificities, these should not be construed as limiting the scope of the invention, but merely as illustrations of the presently preferred embodiments of this invention.

Thus the scope of this invention should be determined by the appended claims and their legal equivalents, rather than by the examples given.

I claim:

1. In a shoe of the type comprising a sole, an outer surface, an instep portion, a tongue, an ankle collar, and lacing flaps, and an integral gaiter being of flexible foldable material and having a lower end, an upper end, and front fastening flaps, which, when fastened, close the gaiter around a leg of a shoe wearer, wherein the improvement comprises said gaiter being attached to an interior surface of an outer side of a closeable, concealing, and protective storage pouch in said ankle collar for storing said gaiter when not in use, with said gaiter and said shoe forming a single, functional, article of footwear.

2. The shoe of claim 1 wherein said gaiter material is sufficiently impermeable to prevent entry to the interior of said shoe and said gaiter of moisture and debris while using said shoe.

3. The shoe of claim 1 wherein said gaiter upper end comprises constrictive material.

4. The shoe of claim 1 wherein said gaiter lower end is secured inside said storage pouch.

5. The shoe of claim 1 wherein said gaiter fastening flaps overlap and secure to each other forming a closed, tubular shape around the wearer's leg.

6. The shoe of claim 1 wherein said gaiter fastening flaps further include a closure system at said gaiter upper end.

7. The shoe of claim 1 wherein said gaiter fastening flaps further include a closure system at said gaiter lower end.

8. The show of claim 1 wherein the height of said gaiter is variable.

9. The shoe of claim 1 wherein the pouch material is sufficiently impermeable to prevent entry to the interior of said pouch of moisture and debris while using said shoe.

10. The shoe of claim 1 wherein said pouch is integrally located at said shoe ankle collar.

11. The shoe of claim 1 wherein said pouch circumscribes said shoe ankle collar.

12. In a shoe and an attached gaiter, said gaiter being formed from flexible foldable material and having an upper end, front flaps, and being storable inside a collar-mounted storage pouch the improvement comprising an integral gaiter and said pouch are integral with said shoe such that said gaiter, said pouch, and said shoe form a single article of footwear.

13. The shoe of claim 12 wherein said gaiter material is sufficiently impermeable to prevent entry to the interior of said shoe and said gaiter of moisture and debris while using said shoe.

14. The shoe of claim 12 wherein said gaiter upper end and said gaiter front flaps form a closure system around the wearer's leg such that entry into the interior of said shoe and said gaiter of moisture, and debris is prevented.

15. A shoe with an integral storable gaiter comprising a gaiter of flexible foldable material attached at a marginal portion thereof to said shoe within a closeable pouch located at an ankle collar of said shoe wherein said pouch is used for storage and protection of said gaiter, said gaiter forms a complete closure system around a wearer's leg and at said shoe when said gaiter is employed for use.

16. The shoe of claim 15 wherein said gaiter material is sufficiently impermeable to prevent moisture and debris from entering the interior of said shoe and said gaiter.

17. The shoe of claim 15 wherein said pouch is integral to said shoe.

18. The shoe of claim 15 wherein said pouch contains a protective closure system around said gaiter when gaiter is stored in said pouch.

* * * * *